US006616775B2

(12) United States Patent
Hewitt

(10) Patent No.: US 6,616,775 B2
(45) Date of Patent: Sep. 9, 2003

(54) HOT FORMING DIE AND A METHOD OF CLEANING A HOT FORMING DIE

(75) Inventor: John Hewitt, Colne (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/986,079

(22) Filed: Nov. 7, 2001

(65) Prior Publication Data

US 2002/0056469 A1 May 16, 2002

(30) Foreign Application Priority Data

Nov. 16, 2000 (GB) ..... 0027951

(51) Int. Cl.[7] ..... B08B 3/02; B08B 3/04
(52) U.S. Cl. ..... 134/38; 134/42
(58) Field of Search ..... 134/22.18, 34, 134/36, 38, 42

(56) References Cited

U.S. PATENT DOCUMENTS 3,850,763 A * 11/1974 Zinnbauer et al. ..... 205/206
6,419,146 B1 * 7/2002 Buldhaupt et al. ..... 228/193
6,508,394 B1 * 1/2003 Buldhaupt et al. ..... 228/157
6,516,645 B2 * 2/2003 Morales et al. ..... 72/53

FOREIGN PATENT DOCUMENTS

| | | |
|---|---|---|
| GB | 1542856 P | 3/1979 |
| GB | 2145357 A | 3/1985 |
| GB | 2195281 A | 4/1988 |

* cited by examiner

*Primary Examiner*—Zeinab El-Arini
(74) *Attorney, Agent, or Firm*—W Warren Taltavull; Manelli Denison & Selter PLLC

(57) ABSTRACT

A hot forming die (10) has forming surfaces (16, 18) and the forming surfaces have a nickel oxide layer (20). A stop off material coating (22) builds up on the nickel oxide layer (20) in operation. A method of cleaning the forming surfaces (16, 18) of the hot forming die (10) includes washing the forming surfaces (16, 18) of the hot forming die (10) in water to remove the stop off material (22) without removing the nickel oxide layer (20) from the forming surfaces (16, 18). The forming surfaces (16, 18) may be soaked in water (26) and/or a jet (30) of pressurized water may be directed onto the forming surfaces (16, 18). The stop off material is quickly removed without damaging the forming surfaces (16, 18). The retention of the nickel oxide layer (20) improves the quality of the hot-formed articles and the interval between cleaning of the hot forming die (10) is increased.

6 Claims, 2 Drawing Sheets

HOT FORMING DIE AND A METHOD OF CLEANING A HOT FORMING DIE

FIELD OF THE INVENTION

The present invention relates to a hot forming die, particularly a superplastic forming die and a method of cleaning a hot forming die, particularly a superplastic forming die.

BACKGROUND OF THE INVENTION

It is known to manufacture articles, or components, using a hot forming process, or a superplastic forming process, in which a hollow metal preform is located in a split hot forming die. The metal preform is heated to a high temperature and pressure is applied internally of the metal preform to form the metal preform into the shape of the split hot forming die.

The split hot forming die is precision cast and precision machined to produce accurately shaped surfaces for the hot forming of the articles or components. The split hot forming die is very expensive to produce and the precision of the surfaces of the split hot forming die determines the shape of the articles or components.

During the hot forming process the high temperature and the pressure applied internally of the metal preform is sufficient to cause the metal preform to become diffusion bonded to the split hot forming die. However, a stop off material, for example boron nitride, is applied to either the surface of the split hot forming die or to the surface of the preform to prevent diffusion bonding between the metal preform and the split hot forming die.

In use the stop off material builds up on the surfaces of the split hot forming die. The stop off material is removed periodically from the surfaces of the split hot forming die because the build up of stop off material gradually effects the quality of the articles, or components, manufactured. Currently the stop off material is removed from the surfaces of the split hot forming die by abrasives, for example grinding wheels, dressing stones etc.

The use of abrasives to remove the stop off material is undesirable because there is a risk that the abrasive may damage the surfaces of the split hot forming die. The damage to the split hot forming die may result in the manufacture of articles, or components, which are not in conformance with the desired shape and size. Additionally the split hot forming die may have to be re-cut to reproduce the accurately formed surfaces of the split hot forming die. Accordingly the present invention seeks to provide a novel method of cleaning a hot forming die which reduces, preferably overcomes, the above mentioned problems.

SUMMARY OF THE INVENTION

Accordingly the present invention provides a method of cleaning a hot forming die, the hot forming die having at least one forming surface and the at least one forming surface having a nickel oxide layer, the method comprising washing the hot forming die in water to remove a stop off material from the at least one forming surface of the hot forming die without removing the nickel oxide layer from the at least one forming surface.

The at least one forming surface of the hot forming die may be soaked in water.

At least one pressurised jet of water may be directed at the at least one forming surface of the hot forming die.

The hot forming die may be a superplastic forming die.

Preferably the hot forming die may comprise an alloy comprising nickel, chromium and iron. Preferably the alloy comprises 55 wt % nickel, 18 wt % chromium and the balance is iron plus incidental impurities.

The present invention seeks to provide a novel hot forming die.

Accordingly the present invention provides a hot forming die having at least one forming surface and the at least one forming surface having a nickel oxide layer.

Preferably the hot forming die is a superplastic forming die.

Preferably the hot forming die may comprise an alloy comprising nickel, chromium and iron. Preferably the alloy comprises 55 wt % nickel, 18 wt % chromium and the balance is iron plus incidental impurities.

BRIEF DESCRIPTION OF THE DRAWINGS

The present invention will be more fully described by way of example with reference to the accompanying drawings in which.

DETAILED DESCRIPTION OF THE INVENTION

Figure 1:
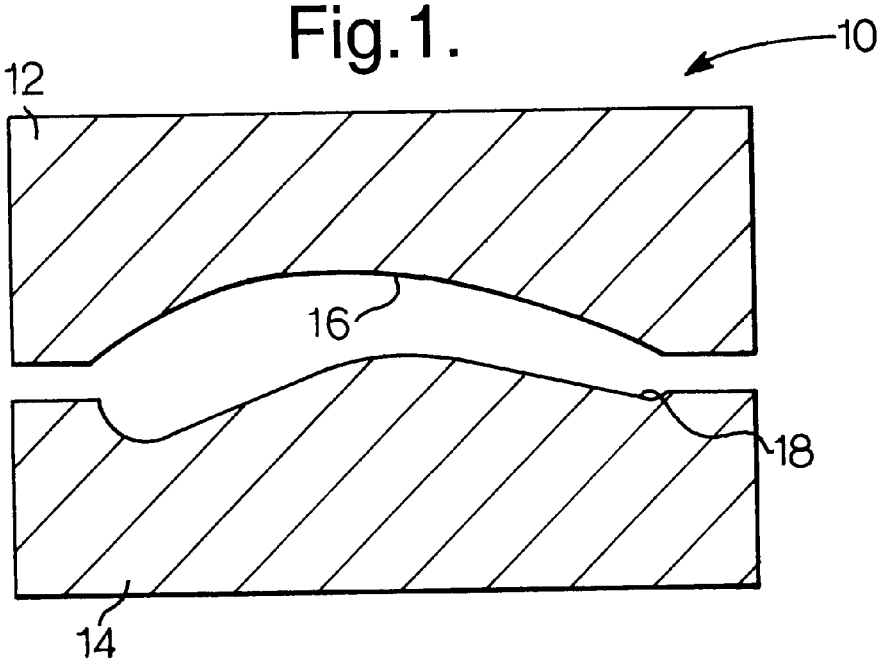
FIG. 1 shows a cross-section through a superplastic forming die.
Figure 2:
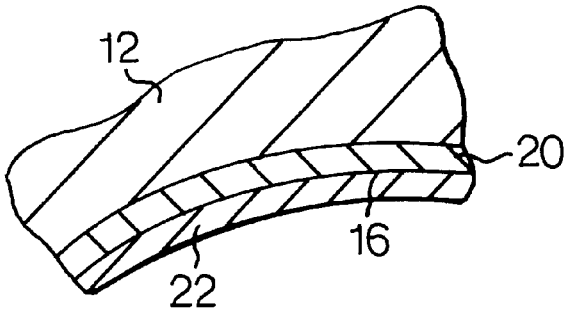
FIG. 2 is an enlarged view of a portion of the superplastic forming die showing the surface of the die and a stop off material to be removed.

A superplastic forming die 10, as shown in FIGS. 1 and 2, comprises two die halves 12 and 14 which have profiled forming surfaces 16 and 18 respectively. The two die halves 12 and 14 comprise an alloy having the trade name CRONITE and this alloy comprises nickel, chromium and iron for example typically 55 wt % nickel, 18 wt % chromium and the balance iron plus incidental impurities. The forming surfaces 16 and 18 comprise a nickel oxide layer 20. The nickel oxide layer 20 is very smooth and hard. A coating of stop off material 22 is present on top of the nickel oxide layer 20 but the stop off material 22 is not part of the forming surfaces 16 and 18 of the superplastic forming die 10.

In operation of the superplastic forming die 10 a metal preform is placed in the superplastic forming die 10. The superplastic forming die 10 and the metal preform are heated up to the superplastic forming temperature, for example 900° C. for a titanium alloy hollow metal preform. An inert gas, for example argon, is introduced into the interior of the metal preform to superplastically form the metal preform to the shape of the forming surfaces 16 and 18 of the superplastic forming die 10 to produce a finished, or semi-finished, hollow article or hollow component.

The profiles of the forming surfaces 16 and 18 of the die halves 12 and 14 respectively determines the shape of the finished, or semi-finished, article or component, after it has been superplastically formed in the superplastic forming die 10.

To prevent the metal preform diffusion bonding to the superplastic forming die 10 during the superplastic forming procedure, a stop off material 22 is applied either to the surfaces of the metal preform or the forming surfaces 16 and 18 of the superplastic forming die 10. The stop off material may be boron nitride or yttria.

During the superplastic forming procedure the stop off material 22 adheres to the forming surfaces 16 and 18 of the die halves 12 and 14 respectively. The continued use of the die halves 12 and 14, to form further hollow articles or hollow components, results in the gradual build up of stop off material 22 on the forming surfaces 16 and 18 of the die halves 12 and 14 respectively. This build up of stop off material 22 on the forming surfaces 16 and 18 of the die halves 12 and 14 effects the quality of the superplastically formed hollow articles or hollow components.

Figure 3:
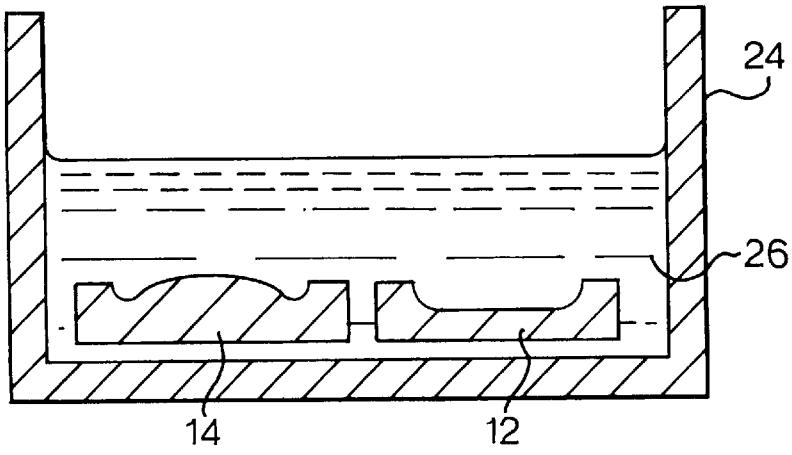
FIG. 3 is a view showing one method of cleaning the superplastic forming dies according to the present invention.

The stop off material 22 is periodically removed from the forming surfaces 16 and 18 of the die halves 12 and 14. The die halves 12 and 14 are placed in a tank 24 containing water 26, as shown in FIG. 3, and the die halves 12 and 14 are allowed to soak in the water 26 to soften the stop off material 22 for a period of time. The die halves 12 and 14 are removed from the water 26 and the stop off material 22 is easily removed from the forming surfaces 16 and 18 of the die halves 12 and 14 by rubbing.

Figure 4:
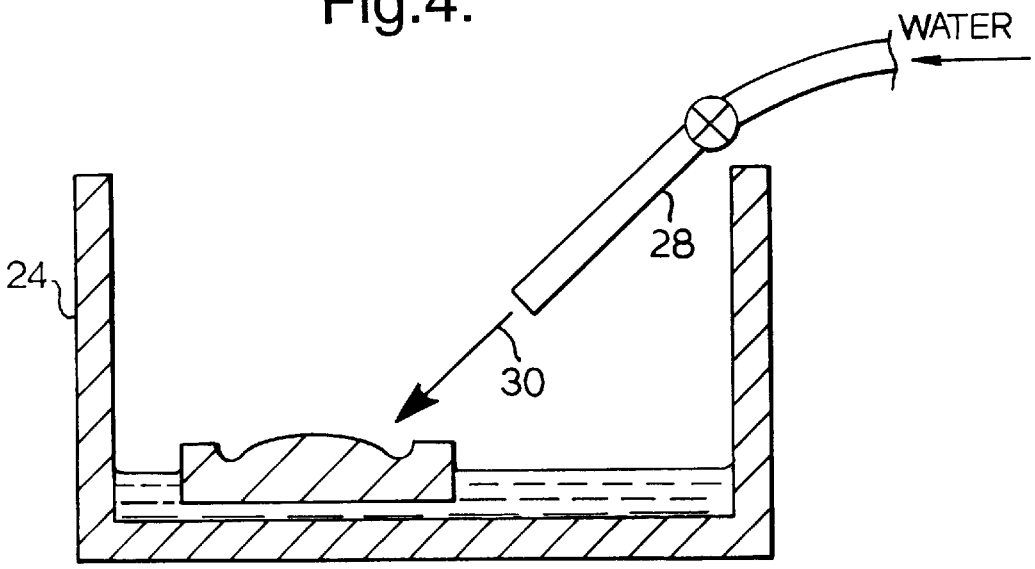
FIG. 4 is a view showing another method of cleaning the superplastic forming dies according to the present invention.

Alternatively the die halves 12 and 14 are placed in a tank 24 and a power washer 28 is arranged to direct a jet of pressurised water 30 onto the forming surfaces 16 and 18, as shown in FIG. 4. The jet of pressurised water 30 easily removes the stop off material from the forming surfaces 16 and 18 of the die halves 12 and 14.

It is also possible to soak the die halves 12 and 14 in the tank 24 of water 26 before directing the jet of pressurised water 30 onto the forming surfaces 16 and 18 of the die halves 12 and 14.

The abrasive cleaning of the forming surfaces of the superplastic forming die is time consuming, requiring for example about twenty hours. The abrasive cleaning has the possibility of damaging the forming surfaces of the die halves, with the consequential cost of refurbishing the die halves and/or a loss in quality of the superplastically formed hollow articles or hollow components. The abrasive cleaning of the superplastic forming die removes the nickel oxide from the forming surfaces of the superplastic forming die and as a result the superplastic forming die requires cleaning every twenty to thirty articles.

An advantage of the present invention is that the water cleaning of the superplastic forming die using the jets of pressurised water is very rapid, requiring only several minutes. This enables the superplastic forming die to be put back into productive use more quickly. The water cleaning of the superplastic forming die does not remove the nickel oxide layer from the forming surfaces of the superplastic forming die and as a result the superplastic forming die only require cleaning every hundred to a hundred and fifty articles. The quality of the superplastically formed articles is improved by retaining the smooth hard nickel oxide layer on the forming surfaces of the superplastic forming die.

Although the invention has referred to superplastic forming dies, the invention is equally applicable to other hot forming dies.

The invention is applicable to the superplastic forming of gas turbine engine fan blades, fan outlet guide vanes, compressor blades, compressor vanes and heat exchangers etc.

I claim:

1. A method of cleaning a hot forming die, the hot forming die having at least one forming surface and the at least one forming surface having a nickel oxide layer, the forming surface having at least a portion thereof coated with a stop off material, the method comprising washing the hot forming die in water to remove the stop off material from the at least one forming surface of the hot forming die without removing the nickel oxide layer from the at least one forming surface.

2. A method as claimed in claim 1 further comprising soaking the at least one forming surface of the hot forming die in water.

3. A method as claimed in claim 1 further comprising directing at least one pressurised jet of water at the at least one forming surface of the hot forming die.

4. A method as claimed in claim 1 wherein the hot forming die is a superplastic forming die.

5. A method as claimed in claim 1 wherein the hot forming die comprises an alloy comprising nickel, chromium and iron.

6. A method as claimed in claim 5 wherein the alloy comprises 55 wt % nickel, 18 wt % chromium and the balance is iron plus incidental impurities.

* * * * *